US006874192B2

(12) United States Patent
To

(10) Patent No.: US 6,874,192 B2
(45) Date of Patent: Apr. 5, 2005

(54) PNEUMATIC CONSTRUCTION OR BRIDGING ELEMENT

(75) Inventor: Frederick E. To, Northampton (GB)

(73) Assignee: Prospective Concepts AG, Glattbrugg (CH)

( * ) Notice: Subject to any disclaimer, the term of this patent is extended or adjusted under 35 U.S.C. 154(b) by 0 days.

(21) Appl. No.: 10/483,169

(22) PCT Filed: Mar. 27, 2002

(86) PCT No.: PCT/CH02/00178

§ 371 (c)(1),
(2), (4) Date: Feb. 6, 2004

(87) PCT Pub. No.: WO03/016634

PCT Pub. Date: Feb. 27, 2003

(65) Prior Publication Data

US 2004/0237225 A1 Dec. 2, 2004

(30) Foreign Application Priority Data

Jul. 20, 2001 (CH) ..... 1347/01

(51) Int. Cl.[7] ..... E01D 15/20
(52) U.S. Cl. ..... 14/2.6; 14/27
(58) Field of Search ..... 14/2.4, 2.6, 27; 114/45, 46, 49, 164–267, 52, 54

(56) References Cited

U.S. PATENT DOCUMENTS

| | | | | | |
|---|---|---|---|---|---|
| 2,480,144 | A | * | 8/1949 | Laycock | 114/266 |
| 2,527,995 | A | * | 10/1950 | Hamilton | 14/27 |
| 2,987,024 | A | * | 6/1961 | Rush | 114/266 |
| 3,894,307 | A | | 7/1975 | Delamare | |
| 4,493,284 | A | * | 1/1985 | Echtler | 114/267 |
| 4,712,335 | A | | 12/1987 | Barkdull, Jr. | |
| 4,754,723 | A | * | 7/1988 | Ghering | 114/353 |
| 5,107,785 | A | * | 4/1992 | Baxter | 114/266 |
| 5,183,001 | A | * | 2/1993 | Stranzinger | 114/266 |
| 5,414,886 | A | * | 5/1995 | Sust et al. | 14/2.5 |
| 5,421,128 | A | | 6/1995 | Sharpless et al. | |
| 6,381,792 | B1 | * | 5/2002 | Woodfin | 14/2.6 |

FOREIGN PATENT DOCUMENTS

| | | |
|---|---|---|
| GB | 1 176 941 | 1/1970 |
| WO | WO-01/73245 A1 | 10/2001 |

* cited by examiner

*Primary Examiner*—Robert E. Pezzuto
*Assistant Examiner*—Alexandra K. Pechhold
(74) *Attorney, Agent, or Firm*—Jenkens & Gilchrist, P.C.

(57) ABSTRACT

The structural or bridge element is constructed from a sheath (1) made of textile fabric, preferably of low extensibility, which is covered in an airtight manner with a flexible plastic. Secured longitudinally within the sheath 1 are a plurality of textile webs of low extensibility in an assembly of mutually parallel planes. The thread profile of first layers 4 of the fabric of the webs 3 is turned through approximately 45° in relation to the longitudinal axis of the bridge element. Second layers 5, each arranged within the same web 3 as the first layer 4, have a thread profile which is selected to be parallel and perpendicular to the longitudinal axis of the bridge element. Bars 6 are arranged on the outside of the sheath 1, respectively in each plane of the webs 3, and are secured within shackles on the sheath 1. The sheath 1 is supplied with compressed air within the range of a few 100 mB. Wherever the bridge element is laid onto the ground of a cutting 8, the sheath 1 is strengthened by means of a protective covering 9.

8 Claims, 2 Drawing Sheets

PNEUMATIC CONSTRUCTION OR BRIDGING ELEMENT

BACKGROUND OF THE INVENTION

The present invention relates to a pneumatic bridge element.

Various pneumatic bridge elements have been disclosed. These usually comprise tubular inflatable hollow bodies having an outer skin made of reinforced plastic films. Special measures are required to absorb the tensile and compressive forces which occur and to prevent buckling of the structural or bridge elements. In principle, the compressive forces are absorbed by one or more compression bars, which are either integrated in the tubular component or are built onto the outside of it. The tensile forces are absorbed by reinforcements applied to the outside or integrated into the plastic film or by special ties. Examples of such structural or bridge elements are disclosed in PCT/CH01/00107, U.S. Pat. Nos. 3,894,307, 4,712,335, and 5,421,128.

What all these structural or bridge elements have in common is the fact that the building of an actual bridge or a component related to it in terms of function requires a number of such tubular elements to be built onto one another laterally, and the fact that the outlay for building and using them can become considerable.

SUMMARY OF THE INVENTION

The object which is to be achieved by means of the present invention is the provision of a pneumatic structural or bridge element which is capable of absorbing large loads, which can be used rapidly and without any major preparations, can be transported easily and produced at low cost. The way in which the set object is achieved is given in the defining part of patent claim 1 with regard to its key features, and in the following patent claims with regard to further advantageous designs.

BRIEF DESCRIPTION OF THE DRAWINGS

The invention will be explained in more detail with reference to the appended drawing, in which.

PREFERRED EMBODIMENT OF THE INVENTION

Figure 1:
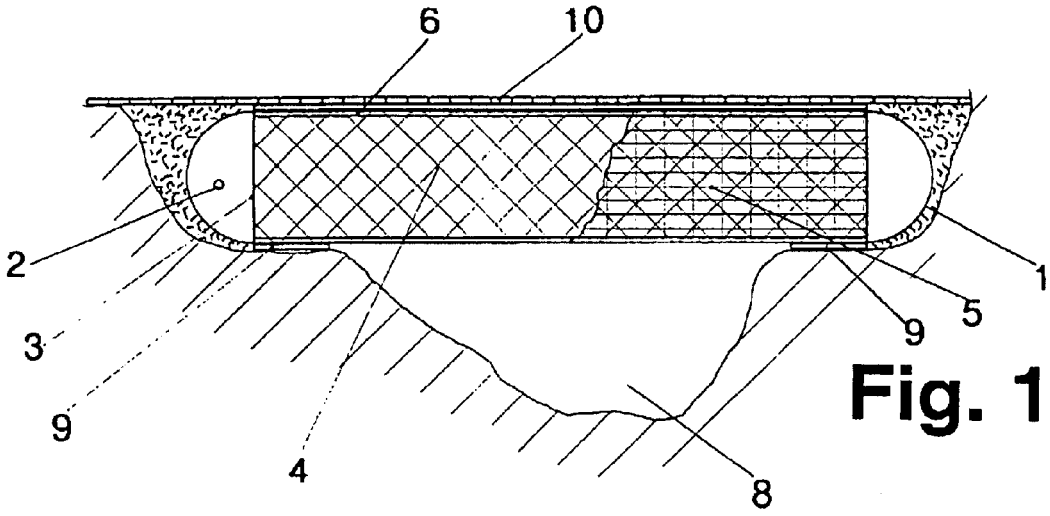
FIG. 1 shows a first exemplary embodiment of the bridge element in longitudinal section.
Figure 2:
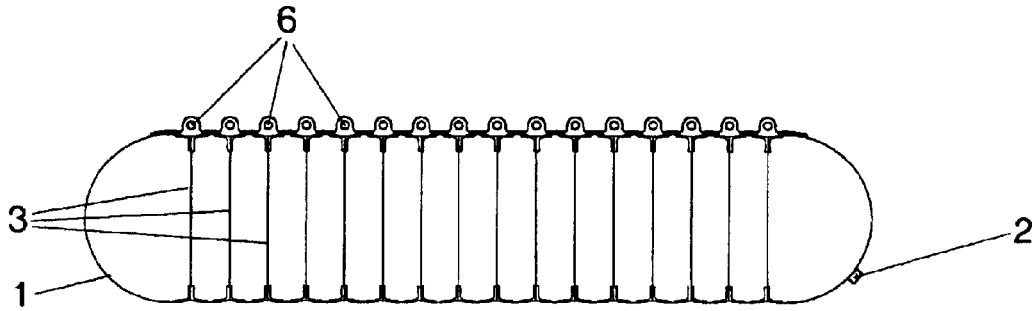
FIG. 2 shows a cross section through a bridge element.

The key structural features can be seen in the longitudinal section through a bridge element according to the invention as shown in FIG. 1 and in cross section as shown in FIG. 2. A sheath 1 of the bridge element comprises a textile fabric, preferably of low extensibility, and is covered with an elastomer or, more generally, a flexible plastic and thus rendered airtight. This sheath 1 can be inflated with compressed air within the range of a few 100 mB via at least one schematically represented valve 2. A plurality of textile webs 3 are arranged between the upper side and the underside of the sheath 1 and connected to the material of the sheath 1 by welding or adhesive bonding. The webs 3 comprise at least a first layer 4 of a fabric, the thread profile of which is turned approximately 45° in relation to the longitudinal direction of the bridge element. A second layer 5 of an identical fabric has a thread profile arranged parallel or perpendicular to the longitudinal direction of the bridge element. The fabric forming the layers 4, 5 likewise preferably has low extensibility. It goes without saying that, according to the invention, two or more first layers 4 can be used for the webs 3 or only every second web can additionally be provided with one or else more than one second layers 5. It is crucial that at least one first layer 4 be used in each web in order to dissipate the tensile forces from the bars 6 to the lower surface of the sheath 1.

Figure 3:
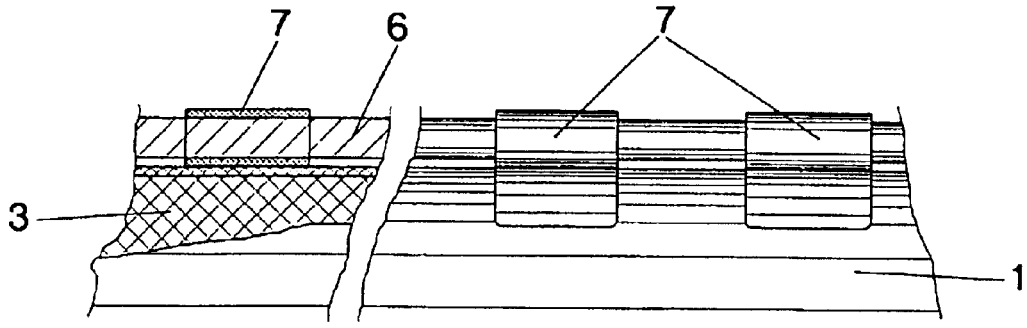
FIG. 3 shows a side view of a detail.

Arranged on the upper side of the bridge element is a plurality of compression bars 6, such that each compression bar 6 runs in the plane defined by the web 3. As shown in FIG. 3, each compression bar 6 is guided and retained in its position by, for example, a plurality of shackles 7. The shackles 7 are connected to the sheath 1 by adhesive bonding or welding. Of course, it is also possible for each compression bar 6 to be provided with only a single shackle 7 extending over its entire surface. The compression bars 7 can be provided in the form of metal bars or tubes, or bars made of GRP, CRP or even wood. Just like the extensibility of the textile materials, the compressive strength of the bars is conditional upon the degree of force to which such a bridge element is subjected and upon the costs to be spent on it.

In FIG. 1, such a bridge element is set up and used for bridging a cutting 8. At the locations where the bridge element is lying on a substrate, it is advantageously strengthened with a protective covering 9, which likewise consists of a flexible plastic, if necessary strengthened by means of further fabric reinforcements. A bridge floor 10, for example of wooden planks, is here laid over the bars 6 in order firstly to protect the sheath 1 and secondly to distribute the forces introduced to the bridge element.

The limit load in the installation represented in FIG. 1 is limited by the pressure prevailing in the sheath 1, the compressive strength of the bars 6 and the tensile and shear strength of the webs 3. In conjunction with the pressure, the size of the bearing surfaces of the bridge element on the ground is also a crucial factor.

Figure 4:
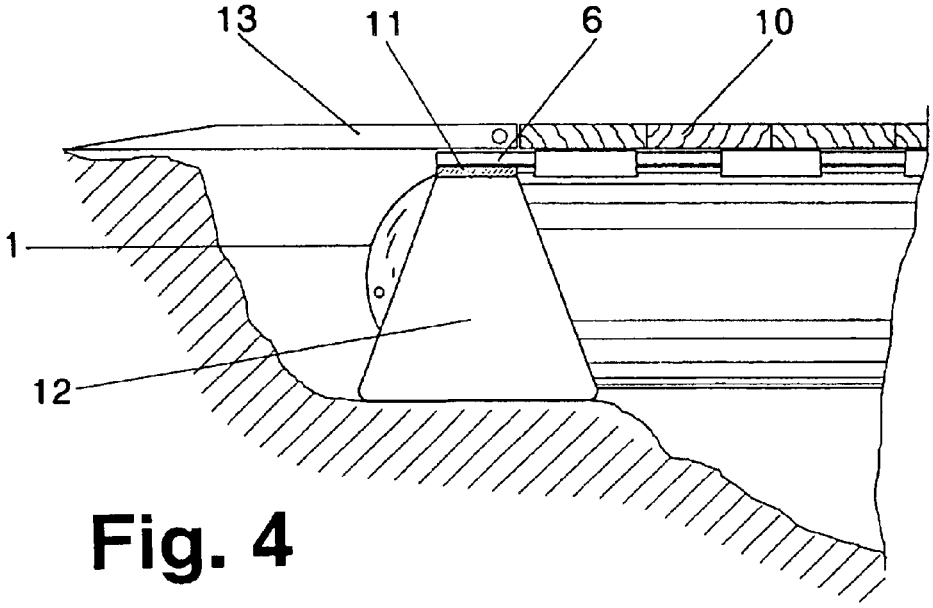
FIG. 4 shows a side view of a second exemplary embodiment.

An alternative to the manner in which the bridge element bears on the natural ground and is constructed thereon, as represented in FIG. 1, can be seen in FIG. 4. Only one end of the bridge element is represented; the other is of a completely identical design. The ends of the bars 6 are supported by means of a suitably formed beam 11 running transversely with respect to the bars 6, and the weight of the bridge element and of its load is dissipated from the beam 11 to the ground via two supports 12. The means for transferring force from the bars 6 to the beam 11 are known per se and are therefore not described further. It is essential to the invention that the bars 6 do not have overhanging ends which are only subjected to bending stress, but that the forces which could give rise to bending are dissipated to the webs 3 in the form of tensile forces. In order to overcome the distance from the natural ground to the bridge floor 10, provision is made here for a ramp 13, which is fastened in an articulated manner to the bridge floor 10 in the region of the beam 11.

In the exemplary embodiment shown in FIG. 1, the bearing points apply substantially only the vertically running reaction forces. The horizontally running compressive forces on the upper side of the bridge element and the horizontal components of the tensile forces running in the webs 3 must be in equilibrium with one another at all times. Therefore, provision is made for the compression bars to be connected nonpositively to the sheath 1—preferably in the shackles 7—either over their entire length, or at least at short intervals. These connections can be performed by mechanical means such as clamping devices, but also by adhesive bonding.

Figure 5:
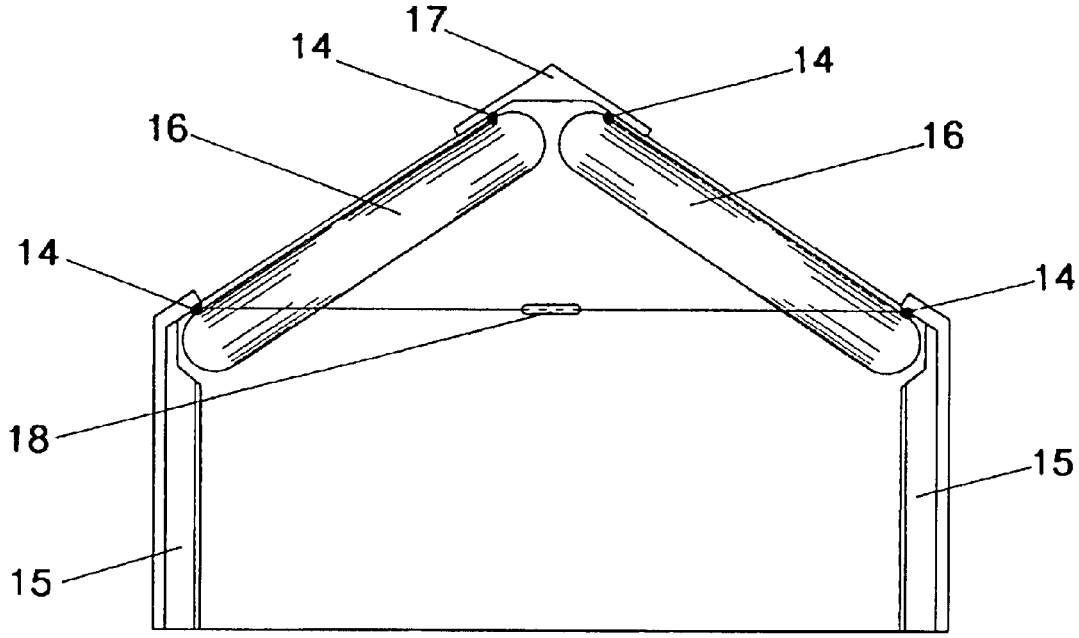
FIG. 5 shows a third exemplary embodiment in a schematic side view.

In the exemplary embodiment shown in FIG. 5, the vertical reaction forces are applied by the beams 11, which directly adjoin the compression bars 6. In this exemplary embodiment and use example, it is only necessary to connect the compression bars 6 non-positively to the sheath 1 at their ends.

According to the invention, the bridge element can be used wherever loads are to be borne by a planar element. This is the case, for example, in a roof. FIG. 5 represents such a use. A schematically represented building, whose basic structure is formed, for example, by a number of steel members 15, bears at least two bridge elements according to FIG. 1 as roof elements 16. These are connected by means of node elements 14 to the steel members 15 at one end and to a so-called Gerber beam 17 at the other end. The node elements 14 take the place of the beams 11 shown in FIG. 4. The connections of the node elements 14 to the compression bars 6 are also known per se and are familiar to a structural engineer.

The Gerber beam 17 is extended beyond the points of connection with the node elements onto the roof elements 16, whereby moments of torsion in the Gerber beam 17, as forces acting perpendicularly thereon, can be transmitted to the compression bars 6, where they are dissipated like normal loads. In reality, this roof forms an actual three-hinged arch having a respective blocked hinge on the side with the larger load. The steel members 15 are guyed relative to one another by means of steel cables 18. Of course, other roof constructions are possible with such roof elements 16, where they are intended to be used to solve relatively straightforward problems associated with statics. Since the compressive forces in the compression bars 6 are here dissipated to the outside via the node elements 14, it is again required for the compression bars 6 to be connected non-positively to the sheath only at the ends of said bars. Between the ends, the compression bars 6 may be able to move longitudinally within the shackles 7.

Figure 6:
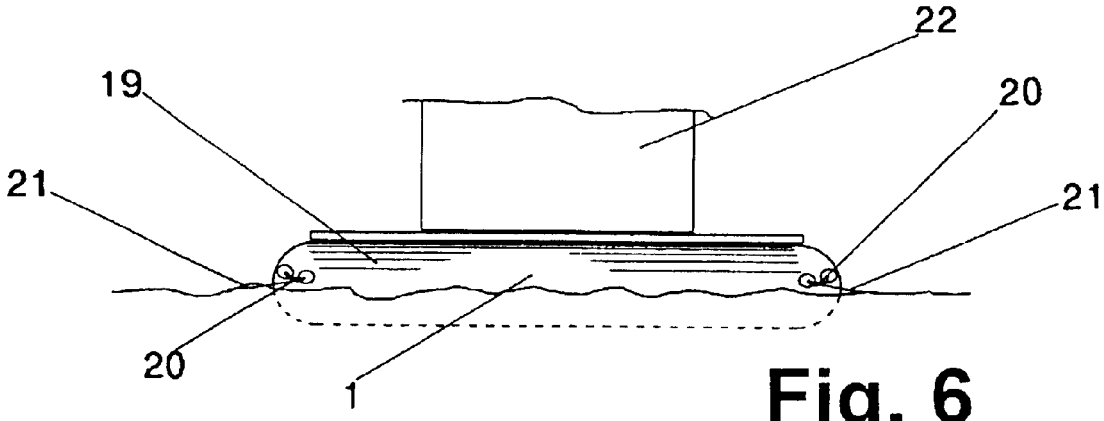
FIG. 6 shows a fourth exemplary embodiment in a schematic side view.

A further use involves the bridge element according to the invention being employed as a pontoon as shown by way of FIG. 6.

What is claimed is:

1. A pneumatic structural or bridge element with a sheath (1) which can be supplied with compressed air via a valve (2) and is made of a textile fabric of low extensibility and an airtight covering made of a flexible plastic, with elements for absorbing compressive forces and those for absorbing tensile forces, characterized in that a plurality of compression bars (6) are arranged parallel to one another at the upper side of the bridge element and are guided in shackles (7) connected to the sheath (1), a number of webs (3) corresponding to the number of compression bars (6) and made of a textile fabric of low extensibility are present and connect the upper side and the underside of the sheath (1), the textile webs (3) are arranged in planes running parallel to one another, each of these said planes also respectively contains one of the compression bars (6), the webs (3) are connected over their entire length to the inner side of the sheath (1), at least one first fabric layer (4) is present for each web (3) and its thread profile is turned through substantially 45° with respect to the longitudinal direction of the bridge element.

2. The pneumatic structural or bridge element as claimed in patent claim 1, characterized in that, in addition to the fabric layers (4) turned through 45°, there are second fabric layers (5) whose thread profile is arranged parallel and perpendicular to the longitudinal direction of the bridge element.

3. The pneumatic structural or bridge element as claimed in patent claim 1 or 2, characterized in that the compression bars (6) are connected nonpositively to the sheath (1) substantially over their entire length.

4. The use of the pneumatic structural or bridge element as claimed in patent claim 3 as a bridge element, in which the sheath (1) is strengthened with a protective covering (9) at least on part of its underside and the bridge element is laid onto the ground by way of its underside.

5. The use of the pneumatic structural or bridge element as claimed in patent claim 3 as a pontoon (19), in which the sheath (1) is provided with mooring means (20) for securing mooring ropes (21).

6. The pneumatic structural or bridge element as claimed in patent claim 1 or 2, characterized in that the compression bars (6) are connected nonpositively to the sheath (1) at their two ends and are guided in the shackles (7) over the remainder of their length, and in that means are mounted at the ends of the compression bars (6) in order to dissipate the bearing forces.

7. The use of the pneumatic structural or bridge element as claimed in patent claim 6 as a roof element (16), in which the means for displacing the bearing forces are node elements (14), by means of which the roof elements (16) are connected to their supporting structure.

8. The use of the pneumatic structural or bridge element as claimed in patent claim 6 as a bridge element, in which the means for dissipating the bearing forces are beams (11) which are arranged transversely with respect to the compression bars (6) and dissipate the bearing forces to the ground via supports (12).

* * * * *